US009031456B2

(12) United States Patent
Mizusawa

(10) Patent No.: US 9,031,456 B2
(45) Date of Patent: May 12, 2015

(54) IMAGE FORMING APPARATUS, DETACHABLE UNIT, AND PLURAL DETACHABLE UNITS

(71) Applicant: Hiroshi Mizusawa, Tokyo (JP)

(72) Inventor: Hiroshi Mizusawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 141 days.

(21) Appl. No.: 13/706,804

(22) Filed: Dec. 6, 2012

(65) Prior Publication Data

US 2013/0163998 A1 Jun. 27, 2013

(30) Foreign Application Priority Data

Dec. 22, 2011 (JP) ..... 2011-281118
Sep. 4, 2012 (JP) ..... 2012-194110

(51) Int. Cl.
*G03G 15/08* (2006.01)
*G03G 21/16* (2006.01)
*G03G 21/18* (2006.01)

(52) U.S. Cl.
CPC ..... *G03G 21/1647* (2013.01); *G03G 21/1871* (2013.01)

(58) Field of Classification Search
CPC ..... G03G 15/0868; G03G 15/0832; G03G 15/0894
USPC ..... 399/25, 111, 120, 107
See application file for complete search history.

(56) References Cited

U.S. PATENT DOCUMENTS

2006/0169067 A1* 8/2006 Yoshizawa ..... 74/1 R
2011/0064452 A1 3/2011 Mizusawa
2011/0206432 A1 8/2011 Ninomiya et al.
2012/0063827 A1 3/2012 Kumagai

FOREIGN PATENT DOCUMENTS

JP 2007-101581 4/2007
JP 2012-083506 4/2012

* cited by examiner

*Primary Examiner* — Roy Y Yi
(74) *Attorney, Agent, or Firm* — Oblon, McClelland, Maier & Neustadt, L.L.P.

(57) ABSTRACT

Disclosed is an image forming apparatus that is to be detachably attached by a detachable unit, wherein the detachable unit includes a unit side connector that fits a main body side connector disposed in a main body of the image forming apparatus by an attaching operation for attaching the detachable unit to the main body of the image forming apparatus, wherein one of the detachable unit and the main body of the image forming apparatus includes a concave portion extended in an attaching direction in which the detachable unit is attached to the main body of the image forming apparatus, and wherein the other one of the detachable unit and the main body of the image forming apparatus includes a convex portion disposed at a position corresponding to the concave portion.

17 Claims, 5 Drawing Sheets

IMAGE FORMING APPARATUS, DETACHABLE UNIT, AND PLURAL DETACHABLE UNITS

BACKGROUND OF THE INVENTION

1. Field of the Invention

An embodiment of the present invention relates to an image forming apparatus such as a copy machine, a printer, a facsimile machine, or a combined machine thereof; a detachable unit detachably attached to the image forming apparatus; and plural detachable units.

2. Description of the Related Art

For an image forming apparatus such as a copier or a printer, a technique has conventionally been known in which, for plural detachable units, corresponding connectors having corresponding different shapes are provided, so as to prevent erroneous insertions of the plural detachable units, which are detachably attached to an image forming apparatus main body (cf. Patent Document 1 (Japanese Patent Laid-Open Application No. 2007-101581)). In such an image forming apparatus, when a detachable unit (e.g., a detachable unit for a magenta color) other than a detachable unit corresponding to a specific mounting unit (e.g., a mounting unit for a black color) is attempted to be attached to the specific mounting unit, a connector of the detachable unit does not engage with a connector at the side of the main body, and thereby the erroneous insertion is prevented.

With such a conventional technique, an effect of preventing a failure in an image forming apparatus can greatly be expected. Here, the failure is such that a detachable unit is attached to a mounting unit other than the mounting unit corresponding to the detachable unit. However, when the detachable unit is attached to the mounting unit other than the mounting unit corresponding to the detachable unit, it is possible that a connector of the detachable unit and a connector at the side of the main body collide with each other without engaging with each other, and thereby the connector of the detachable unit and the connector at the side of the main body are damaged. Such a problem may not be ignored, especially when a user attempts to force a wrong detachable unit to a mounting unit.

SUMMARY OF THE INVENTION

The embodiment of the present invention has been developed to overcome the above-described problem. An objective of the embodiment of the present invention is to provide an image forming apparatus, a detachable unit, and plural detachable units such that, even if a wrong detachable unit is attached to a main body of the image forming apparatus, damage on a connector of the detachable unit and a connector at a side of the main body due to forcible contact can be avoided and the erroneous insertion can be prevented.

In one aspect, there is provided an image forming apparatus configured to be detachably attached by a detachable unit, wherein the detachable unit includes a unit side connector configured to fit a main body side connector disposed in a main body of the image forming apparatus, wherein the unit side connector fits the main body side connector by an attachment operation for attaching the detachable unit to the main body of the image forming apparatus, wherein one of the detachable unit and the main body of the image forming apparatus includes a concave portion extended in an attaching direction in which the detachable unit is attached to the main body of the image forming apparatus, and wherein the other one of the detachable unit and the main body of the image forming apparatus includes a convex portion disposed at a position corresponding to the concave portion.

In another aspect of the present invention, there is provided a detachable unit configured to be detachably attached to a main body of an image forming apparatus including a main body side connector, the detachable unit including a unit side connector configured to fit the main body side connector by an attaching operation for attaching the detachable unit to the main body of the image forming apparatus, wherein one of the detachable unit and the main body of the image forming apparatus includes a concave portion extended in an attaching direction in which the detachable unit is attached to the main body of the image forming apparatus, and wherein the other one of the detachable unit and the main body of the image forming apparatus includes a convex portion disposed at a position corresponding to the convex portion.

In another aspect of the present invention, there are provided plural detachable units configured to be detachably attached to corresponding mounting units of a main body of an image forming device, each of the mounting units includes a main body side connector, each of the detachable units including a unit side connector configured to fit the corresponding main body side connector of the corresponding mounting unit, wherein the unit side connector fits the corresponding main body side connector by an attaching operation for attaching the detachable unit to the corresponding mounting unit, wherein, for each of combinations of the detachable units and the corresponding mounting units, one of the detachable unit and the corresponding mounting unit includes a concave portion extended in an attaching direction for attaching the detachable unit to the corresponding mounting unit, and the other one of the detachable unit and the corresponding mounting unit includes a convex portion disposed at a position corresponding to the concave portion, and wherein the positions of the convex portions and the corresponding concave portions are different from each other, depending on the combinations of the detachable units and the corresponding mounting units.

In this manner, the image forming apparatus, the detachable unit, and the plural detachable units can be provided such that, even if the wrong detachable unit is attached to the main body of the image forming apparatus, damage on the unit side connector and on the main body side connector due to the forcible contact can be avoided and the erroneous insertion can be prevented.

Other objects, features and advantages of the present invention will become more apparent from the following detailed description when read in conjunction with the accompanying drawings.

DETAILED DESCRIPTION OF THE PREFERRED EMBODIMENTS

Figure 1:
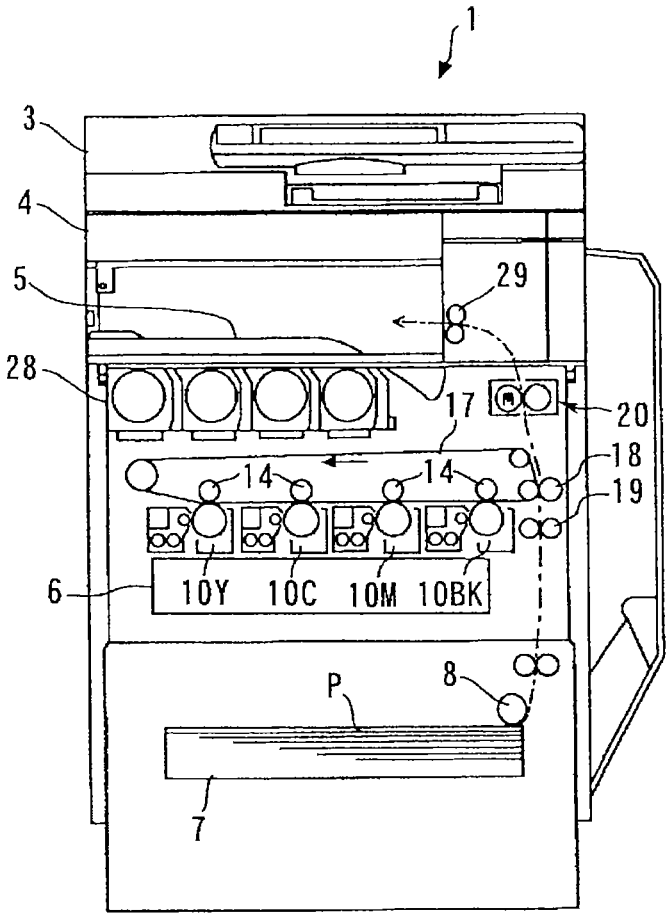
FIG. 1 is a diagram showing an overall configuration of an image forming apparatus according to an embodiment of the present invention.

Hereinafter, an embodiment of the present invention will be explained by referring to the accompanying drawings. In the drawings, the same reference numerals are attached to the same or corresponding portions, and thereby overlapping explanations are arbitrarily simplified or omitted.

In the explanation below, a "process cartridge" is defined to be one embodiment of the detachable unit that is detachably attached to the main body of the image forming apparatus. In the detachable unit, at least one of a charging unit for charging an image carrying body, a developing unit (developing device) for developing a latent image formed on the image carrying body; and a cleaning unit for cleaning the image carrying body; and the image carrying body are integrated.

First, a configuration and operations of a whole image forming apparatus 1 will be explained by referring to FIG. 1. The image forming apparatus 1 according to the embodiment is a tandem type color image forming apparatus where process cartridges 10Y, 10M, 100, and 10BK as plural detachable units are arranged in parallel while facing an intermediate transfer belt 17.

As shown in FIG. 1, the image forming apparatus 1 includes a main body of a color copy machine as the image forming apparatus; a document feeder 3 that feeds documents to a document reading unit 4; the document reading unit 4 for reading image information of documents; a writing unit (an exposing unit) 6 that emits laser light based on the input image information; a paper feeding tray 7 that stores sheets of a recording medium P such as transfer paper; process cartridges 10Y, 10M, 10C, and 10BK as detachable units corresponding to colors of yellow, magenta, cyan, and black; the intermediate transfer belt 17 on which toner images in the corresponding colors are transferred while being superposed; a secondary transfer roller 18 that transfers the image that has been formed on the intermediate transfer belt 17 onto the sheet of the recording medium P; a fixing unit 20 that fixes the image which has been transferred onto the sheet of the recording medium P and which has not been fixed on the sheet of the recording medium P; and toner containers 28 that supply toner in the corresponding colors to the corresponding process cartridges 10Y, 10M, 10C, and 10BK (the detachable units).

Figure 2:
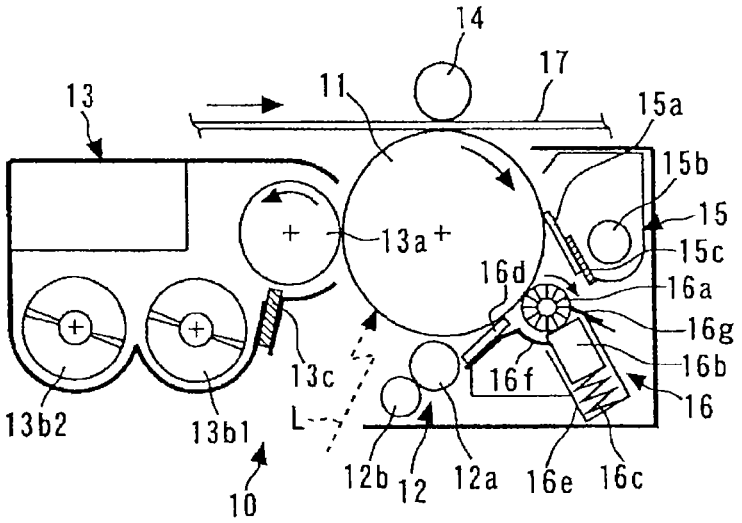
FIG. 2 is a diagram showing a detachable unit and the vicinity of the detachable unit.

In each of the process cartridges (the detachable units) 10Y, 10M, 10C, and 10BK, a photosensitive drum 11 as an image carrying body; a charging unit 12; a developing unit (developing device) 13; a cleaning unit (cleaning device) 15; and a lubricant supply device (lubricant supply unit) 16 are integrated (cf. FIG. 2). Each of the process cartridges (the detachable units) 10Y, 10M, 10C, and 10BK is detachably attached to the main body of the image forming apparatus 1. When the process cartridges 10Y, 10M, 10C, and 10BK reach the end of their operational lives, the process cartridges 10Y, 10M, 10C, and 10BK are replaced with corresponding new cartridges. On the photosensitive drums 11 (the image carrying bodies) of the process cartridges 10Y, 10M, 10C, and 10BK, a yellow toner image, a magenta toner image, a cyan toner image, and a black toner image are formed, respectively.

Hereinafter, there will be explained operations of the image forming apparatus 1 for forming a normal color image. First, a document is transferred from a copy holder (not shown) by a conveyance roller of the document feeder 3, and the document is placed on a contact glass of the document reading unit 4. Subsequently, image information of the document placed on the contact glass is read by the document reading unit 4. Specifically, the document reading unit 4 irradiates and scans light emitted from an illumination lamp onto the document on the contact glass. The light reflected on the document is focused onto a color sensor through a group of mirrors and lenses. The color image information of the document is read for color separation light of a red color, a green color, and a blue color (RGB) by the color sensor, and the color image information is converted into electric signals. Further, an image processing unit (not shown) performs processes such as a color conversion process, a color correction process, and a spatial frequency correction process, based on color separation image signals of the red color, the green color, and the blue color, thereby obtaining color image information for the yellow color, the magenta color, the cyan color, and the black color.

Subsequently, the yellow color image information, the magenta color image information, the cyan color image information, and the black color image information are transmitted to the writing unit 6. The writing unit 6 irradiates laser light (exposing light) based on the yellow color image information, the magenta color image information, the cyan color image information, and the black color image information onto the photo sensitive drums 11 of the corresponding process cartridges 10Y, 10M, 10C, and 10BK.

Referring to FIG. 2, the four photosensitive drums 11 rotate in the clockwise direction in the figure. Surfaces of the photosensitive drums 11 are uniformly charged at positions facing corresponding charging rollers 12*a* (the charging units 12) (a charging process). In this manner, charge potentials are formed on the corresponding photosensitive drums 11. Subsequently, the charged surfaces of the photosensitive drums 11 reach irradiation positions of the laser light. In the writing unit 6, laser beams having the colors corresponding to the image signals are irradiated from a light source. Through it is not shown in the figures, after the laser beams have entered the corresponding polygon mirrors and have been reflected, the laser beams pass through plural lenses. After passing through the plural lenses, the laser beams pass through individual optical paths corresponding to the yellow color component, the magenta color component, the cyan color component, and the black color component (an exposing process).

The laser beam corresponding to the yellow color component is irradiated onto the surface of the photosensitive drum 11 of the process cartridge 10Y at the left most side in FIG. 1. At this time, the laser beam corresponding to the yellow color component is scanned in a direction of a rotational axis of the photosensitive drum 11 (main scanning direction) by the rapidly rotating polygon mirror (not shown). In this manner, an electrostatic latent image corresponding to the yellow color component is formed on the photosensitive drum 11 which has been charged by the charging roller 12*a*.

Similarly, the laser beam corresponding to the cyan color component is irradiated onto the surface of the photosensitive drum 11 of the process cartridge 10C at the second position from the left in FIG. 1, and thereby an electrostatic latent image corresponding to the cyan color component is formed. The laser beam corresponding to the magenta color component is irradiated onto the surface of the photosensitive drum 11 of the process cartridge 10M at the third position from the left in FIG. 1, and thereby an electrostatic latent image corresponding to the magenta color component is formed. The laser beam corresponding to the black color component is irradiated onto the surface of the photosensitive drum 11 of the process cartridge 10BK at the fourth position from the left in FIG. 1 (the downstream most side in a direction in which the intermediate transfer belt 17 rotates), and thereby an electrostatic latent image corresponding to the black color component is formed.

Subsequently, the surfaces of the photosensitive drums 11 on which the electrostatic latent images in the corresponding colors have been formed reach corresponding positions facing the corresponding developing units 13. Then, the developing devices 13 supply toner in the corresponding colors onto the corresponding photosensitive drums 11, and thereby the latent images on the corresponding photosensitive drums 11 are developed (developing process). After the developing process, the surfaces of the photosensitive drums 11 reach the corresponding positions where the surfaces of the photosensitive drums 11 face the intermediate transfer belt 17. Here, primary transfer rollers 14 are disposed at the positions where the corresponding surfaces of the photosensitive drums 11 face the intermediate transfer belt 17, while the primary transfer rollers 14 contact an inner circumferential surface of the intermediate transfer belt 17. The toner images in the corresponding colors formed on the corresponding photosensitive drums 11 are transferred onto the intermediate transfer belt 17 at the positions of the corresponding primary rollers 14. In this manner, the toner images in the corresponding colors are sequentially superposed on the intermediate transfer belt 17 (primary transfer process).

After the primary transfer process, the surfaces of the photosensitive drums 11 reach the positions facing corresponding cleaning units 15. The cleaning units 15 collect the toner remaining on the corresponding photosensitive drums 11 that has not been transferred (cleaning process). After that, the surfaces of the corresponding photosensitive drums 11 sequentially pass through positions of the corresponding lubricant supply devices 16 and positions of the corresponding charge removing units (not shown), and thereby the image forming processes of the corresponding photosensitive drums 11 are completed.

On the other hand, the surface of the intermediate transfer belt 17, on which the images in the corresponding colors on the photosensitive drums 11 have been superposed, moves in a direction indicated by the arrow in FIG. 1 and reaches a position of the secondary transfer roller 18. Subsequently, the full color image on the intermediate transfer belt 17 is secondarily transferred onto the sheet of the recording medium P at the position of the secondary transfer roller 18 (secondary transfer process). After that, the surface of the intermediate transfer belt 17 reaches a position of an intermediate transfer belt cleaning unit (not shown). The toner that has not been transferred and remaining on the intermediate transfer belt 17 is collected by the intermediate transfer belt cleaning unit, and thereby the sequence of transfer processes for transferring the toner onto the intermediate transfer belt 17 is completed.

The sheet of the recording medium P at the position of the secondary transfer roller 18 has been conveyed from the paper feeding tray 7 through a conveyance guide and registration rollers 19. Specifically, the sheet of the recording medium P that has been fed by a feeding roller 8 from the paper feeding tray 7 that stores the sheets of the recording medium P passes through the conveyance guide. After that, the sheet of the recording medium P is guided toward the registration rollers (timing rollers) 19. The sheet of the recording medium P that has reached the registration rollers 19 is conveyed toward the position of the secondary transfer roller 18 in synchronization with the timing of the toner image on the intermediate transfer belt 17.

After that, the sheet of the recording medium P, on which the full color image has been transferred, is guided toward the fixing unit 20. At the fixing unit 20, the full color image is fixed onto the sheet of the recording medium P by nipping between a fixing roller and a pressing roller. After the fixing process, the sheet of the recording medium P is discharged outside the main body of the image forming apparatus 1 by paper discharging rollers 29 as an output image. Then, the sheet of the recording medium P is stacked on the paper discharging unit 5, and thereby the sequence of the image forming processes is completed.

Next, the process cartridge 10 (the detachable unit) will be explained in detail by referring to FIG. 2. Here, the process cartridges 10Y, 10M, 10C, and 10BK are formed of almost the same components, except that the colors of the toner used for the image forming processes are different and that the shapes of the unit side connectors 51 (described in detail later) and the positions of the concave portions 52 (described in detail later) are different. Therefore, in FIG. 2 and the like, the process cartridges 10Y, 10M, 10C, and 10BK are indicated while the alphabet symbols Y, M, C, and Bk that have been attached to the reference numeral 10 of the process cartridges 10Y, 10M, 10C, and 10BK are removed.

As shown in FIG. 2, the process cartridge 10 includes the photosensitive drum 11 as the image carrying body; the charging unit 12 that charges the photosensitive drum 11; the developing unit 13 that develops the electrostatic latent image formed on the photosensitive drum 11; the cleaning unit 15 that collects the toner that has not been transferred and remaining on the photosensitive drum 11; and the lubricant supply device 16 that supplies the lubricant onto the photosensitive drum 11. In the process cartridge 10, the photosensitive drum 11, the charging unit 12, the developing unit 13, the cleaning unit 15, and the lubricant supply device 16 are integrally stored in a casing.

Here, the photosensitive drum 11 as the image carrying body is formed of an electrically conductive support body having a drum shape and a photosensitive layer covering the electrically conductive support body, where the photosensitive layer is formed of an organic photosensitive body having a negative chargeability. Though it is not shown in FIG. 2, the photosensitive drum 11 is formed by laminating an under coat layer that is an insulating layer, a charge generation layer as a photosensitive layer, a charge transport layer, and a protection layer (surface layer) in this order on the electrically conductive support body as a basic layer.

The charging unit 12 includes the charging roller 12*a* and a cleaning roller 12*b*. The charging roller 12*a* is a roller member formed by covering a circumference of a conductive metal core with an elastic layer having a medium resistance. The charging roller 12*a* is disposed downstream from the lubricant supply device 16 in a direction in which the photosensitive drum 11 rotates. The charging roller 12*a* is disposed to face the photosensitive drum 11 while the charging roller 12*a* is separated from the photosensitive drum 11, so that the lubricant supplied to the surface of the photosensitive drum 11 by the lubricant supply device 16 does not adhere to the charging roller 12*a*. The cleaning roller 12*b* is for removing smears on the charging roller 12*a*. The cleaning roller 12*b* is disposed to contact the charging roller 12*a*. In the thus formed charging unit 12, a predetermined electric voltage (a charging bias) is applied from a power supply unit (not shown) to the charging roller 12*a*, and thereby the surface of the photosensitive drum 11 facing the charging unit 12 is uniformly charged.

The developing unit (developing device 13) mainly includes a developing roller 13*a* that faces the photosensitive drum 11; a first conveyance screw 13*b*1 that faces the developing roller 13*a*; a second conveyance screw 13*b*2 that faces the first conveyance screw 13*b*1 through a partition member; and a doctor blade 13*c* that faces the developing roller 13*a*. The developing roller 13*a* includes a magnet that is fixed inside the developing roller 13*a* and that forms magnetic poles on a circumference of the developing roller 13*a*; and a sleeve that rotates around the magnet. The magnet generates plural magnetic poles on the developing roller 13*a* (the sleeve), and thereby the developer is carried on the developing roller 13*a*. Two-component developer including carrier and toner is stored inside the developing unit 13.

The cleaning unit 15 is disposed upstream from the lubricant supply device 16 in the direction in which the photosensitive drum 11 rotates. The cleaning unit 15 includes a cleaning blade 15*a* that contacts the photosensitive drum 11; a holding member (a holder) 15*c* that holds the cleaning blade 15*a*; a conveyance coil (conveyance member) 15*b* that conveys the toner collected inside the cleaning unit 15 to a waste toner collecting container (not shown) as waste toner. The cleaning blade 15 is formed of a rubber material such as a urethane rubber. The cleaning blade 15*a* contacts the surface of the photosensitive drum 11 at a predetermined pressure while forming a predetermined angle with the surface of the photosensitive drum 11. With this configuration, the cleaning blade 15*a* mechanically scrapes and removes an adhesive material such as the toner which has not been transferred and which has adhered to the surface of the photosensitive drum 11, and the removed adhesive material is collected inside the cleaning unit 15. Here, the adhesive material that adheres to the surface of the photosensitive drum 11 includes, in addition to the toner that has not been transferred, paper dust originated from the sheet of the recording medium (recording paper) P, corona products that are generated on the photosensitive drum 11 during discharging of the charging roller 12*a*, and an additive that is added to the toner, for example. In the process cartridge 10, the conveyance coil (conveyance member) 15*b* as a rotational member is rotatably supported by the chassis through bearings 15*b*1 at both end portions in the width direction (cf. FIG. 6B).

The lubricant supply device 16 includes a solid lubricant 16*b*; a brush-shaped rotating member 16*a* around which bristles that slidably contact the photosensitive drum 11 and the solid lubricant 16*b* are formed; a compression spring 16*c* that presses the solid lubricant 16*b* toward the brush-shaped rotating member 16*a*; a blade member 16*d* that shapes the lubricant supplied onto the photosensitive drum 11 by the brush-shaped rotating member 16*a* to be a thin film; a holder 16*e* that holds the solid lubricant 16*b*; a guide unit 16*f* that faces the brush-shaped rotating member 16*a* at a position downstream from the solid lubricant 16*b*; and a flicker member 16*g* that contacts the brush-shaped rotating member 16*a* at a position upstream from the solid lubricant 16*b*. The blade member 16*d* contacts the photosensitive drum 11 at a position downstream from the brush-shaped rotating member 16*a* in the direction in which the photosensitive drum 11 rotates. Here, the blade member 16*d* contacts the photosensitive drum 11 in a direction opposite to the direction in which the photosensitive drum 11 rotates. By the lubricant supply device 16 having such a configuration, the lubricant is supplied onto the photosensitive drum 11 while the lubricant is shaped in the thin film shape.

Hereinafter, there will be explained the image forming process (which has been explained above) in detail by referring to FIG. 2. The developing roller 13*a* is rotating in the direction (counterclockwise direction) indicated by the arrow in FIG. 2. The developer in the developing unit 13 circulates in a longitudinal direction (the direction perpendicular to the paper surface of FIG. 2), while the developer is agitated and mixed with toner supplied from the toner container 28 by a toner supply unit (not shown) by rotations of the first conveyance screw 13*b*1 and the second conveyance screw 13*b*2. The first conveyance screw 13*b*1 and the second conveyance screw 13*b*2 are disposed in the developing unit 13 while being separated by a partition member.

The toner sticking to the carrier is supported on the developing roller 13*a* together with the carrier. Subsequently, the developer supported on the developing roller 13*a* reaches the position of the doctor blade 13*c*. The developer on the developing roller 13*a* is adjusted to be a suitable amount at the position of the doctor blade 13*c*, and subsequently the developer on the developing roller 13*a* reaches the position facing the photosensitive drum 11 (developing area).

After that, at the developing area, the toner included in the developer adheres to the electrostatic latent image formed on the surface of the photosensitive drum 11. Specifically, the toner adheres to the latent image (the toner image is formed) by the electric field generated by an electric potential difference (developing potential) between a latent image electric potential (exposure potential) of the image portion that has been irradiated by the laser light L and the developing bias applied to the developing roller 13*a*.

After that, almost all the toner that has adhered to the photosensitive drum 11 at the developing process is transferred onto the intermediate transfer belt 17. The toner that has not been transferred and that is remaining on the photosensitive drum 11 is collected inside the cleaning unit 15 by the cleaning blade 15*a*.

Though it is not shown in the figure, the toner supply unit disposed in the main body of the image forming apparatus 1 includes the replaceable toner container 28 having a bottle-like shape; and a toner hopper that holds and rotationally drives the toner container 28. Additionally, the toner hopper supplies new toner to the developing unit 13. In the toner container 28, the new toner (the color of which is one of yellow, magenta, cyan, and black) is stored. Further, a spiral protrusion is formed on an inner circumferential surface of the toner container 28 (toner bottle).

The new toner inside the toner container 28 is suitably supplied to the developing unit 13 from a toner supply port, as the toner inside the developing unit 13 (the toner that has been stored in the developing unit 13) is consumed. Though it is not shown in the figures, the consumption of the toner inside the developing unit 13 is directly or indirectly detected by a reflective photosensor facing the photosensitive drum 11 and a magnetic sensor disposed below the second conveyance screw 23*b*2 of the developing unit 13.

Hereinafter, there will be explained a specific configuration and operations of the image forming apparatus 1 according to the embodiment. As described above, the four process cartridges 10Y, 10M, 10C and 10BK function as the detachable units that are detachably attached to the main body of the image forming apparatus 1. Specifically, as shown in FIG. 1, when a door, which opens and closes (not shown), of the main body of the image forming apparatus 1 is opened, the four mounting portions for mounting the corresponding four process cartridges 10Y, 10M, 10C, and 10BK are exposed. The four process cartridges 10Y, 10M, 10C, and 10BK are attached to and detached from the main body of the image forming apparatus 1 (the mounting portions) while setting the longitudinal direction as the direction in which the cartridges are attached to and detached from the main body of the image forming apparatus 1 (attaching and detaching operations in the direction perpendicular to the paper surface of FIG. 1).

The four process cartridges 10Y, 10M, 10C, and 10BK are only attached to the corresponding mounting portions. In each of the four process cartridges 10Y, 10M, 10C, and 10BK, an incompatible shaped unit (the unit side connector 51 and the concave portion 52) is disposed at a back side in the direction in which the process cartridges 10Y, 10M, 10C, and 10BK are attached. Each of the incompatible shaped units is not compatible with the mounting units other than the corresponding mounting unit. Therefore, the process cartridges 10Y, 10M, 10C, and 10BK are prevented from being attached to the wrong mounting units (an erroneous insertion is prevented). Similarly, in the four mounting units of the main body of the image forming apparatus 1, corresponding incompatible shaped units (the main body side connectors 101 and the convex portions 102) are disposed at inner parts in the direction in which the process cartridges 10Y, 10M, 10C, and 10BK are attached. Each of the incompatible shaped units is not compatible with the mounting units other than the corresponding mounting unit. Therefore, the process cartridges 10Y, 10M, 10C, and 10BK are prevented from being attached to the wrong mounting units (the erroneous insertion is prevented).

Figure 3:
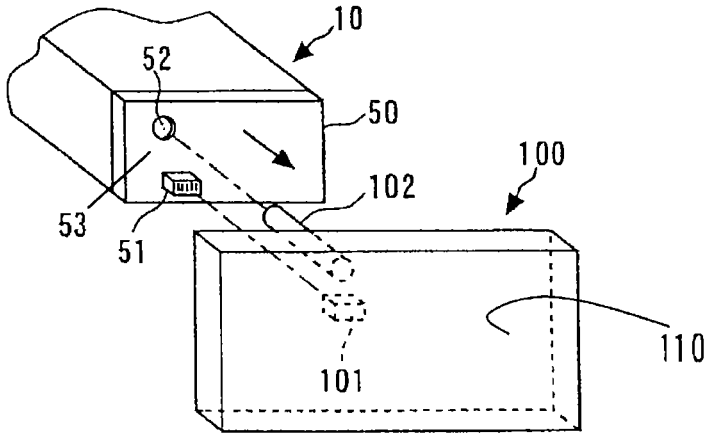
FIG. 3 is a schematic perspective view showing a state where the detachable unit is attached to a main body of the image forming apparatus.
Figure 5A:
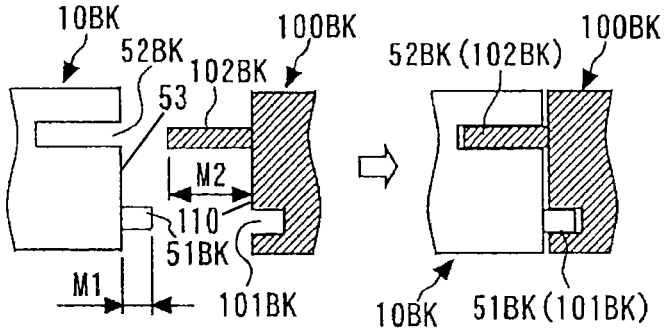
FIG. 5A is a schematic diagram showing a state where the detachable unit is attached to a corresponding mounting unit of the main body of the image forming apparatus.

Specifically, as shown in FIG. 3, a unit side plate 50 of the process cartridge 10 includes the unit side connector 51 that fits the main body side connector 101 included in the main body side plate 100 of the main body of the image forming apparatus 1 by the attachment operation for attaching the process cartridge 10. The unit side connector 51 is formed to protrude from an end surface 53 of the unit side plate 50 toward the main body side plate 100. The main body side connector 101 is formed to have a concave shape on an end surface 110 of the main body side plate 100 that faces the end surface 53 of the unit side plate 50, so that the main body side connector 101 is separated from the unit side plate 50. Referring to FIG. 5A, when the process cartridge 10 is correctly mounted on the main body of the image forming apparatus 1 (the mounting unit), the unit side connector 51 having the convex shape fits the main body side connector 101 having the concave shape, and thereby an electrical connection between the main body of the image forming apparatus 1 and the process cartridge 10 is established. Specifically, the charging bias is supplied from the main body side connector 101, which is connected to the power supply of the main body of the image forming apparatus 1 through a harness, to the charging roller 12*a* through the unit side connector 51; the developing bias is supplied to the developing roller 13*a*; and a base layer of the photosensitive drum 11 is grounded, for example.

Figure 4A:
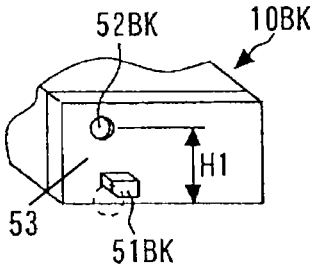
FIG. 4A is a diagram showing major portions of a unit side connector for a black color.
Figure 4B:
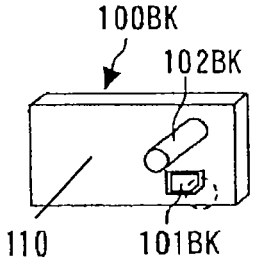
FIG. 4B is a diagram showing major portions of a main body side connector for the black color.
Figure 4C:
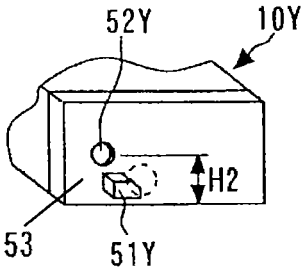
FIG. 4C is a diagram showing major portions of a unit side connector for a yellow color.
Figure 4D:
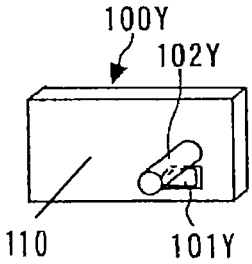
FIG. 4D is a diagram showing major portions of a main body side connector for the yellow color.

Among the four combinations of the process cartridges 10Y, 10M, 10C, and 10BK and the corresponding mounting units, the shapes of the unit side connector 51 and the corresponding main body side connector 101 of one combination are different from those of any other combinations. Specifically, as shown in FIGS. 4A-4D, the unit side connector 51 and the main body side connector 101 are shaped such that a position of a notch surrounded by the broken line for one color is different from that for another color. In particular, as shown in FIG. 4A, in the unit side connector 51BK of the process cartridge 10BK for the black color, the notch is formed in the lower left position, when the notch is viewed from the main body side plate 100. Further, as shown in FIG. 4B, in the main body side connector 101BK of the main body side plate 100BK (the mounting unit) for the black color, the notch is formed in the lower right position, when the notch is viewed from the unit side plate 50. On the other hand, as shown in FIG. 4C, in the unit side connector 51Y of the process cartridge 10Y for the yellow color, the notch is formed in the upper right position, when the notch is viewed from the main body side plate 100. Further, as shown in FIG. 4D, in the main body side connector 101Y of main body side plate 100Y (the mounting unit) for the yellow color, the notch is formed in the upper left position, when the notch is viewed from the unit side plate 50. With such a configuration, when the process cartridge 10BK for the black color is erroneously attempted to be mounted on the mounting unit for the yellow color (the main body side plate 100Y), the unit side connector 51BK for the black color does not fit the main body side connector 101Y for the yellow color, thereby preventing the erroneous insertion. Similarly, when the process cartridge 10Y for the yellow color is erroneously attempted to be mounted on the mounting unit for the black color (the main body side plate 100BK), the unit side connector 51Y for the yellow color does not fit the main body side connector 101BK for the black color, thereby preventing the erroneous insertion. In FIGS. 4A-4D, only the process cartridges 10Y and 10BK and the mounting units for the black color and the yellow color are shown, among the four process cartridges 10Y, 10M, 10C, and 10BK and the four mounting units. However, the shapes of the unit side connector 51 and the main side connector 101 for the magenta color are formed to be different from those of the other colors. Similarly, the shapes of the unit side connector 51 and the main side connector 101 for the cyan color are formed to be different from those of the other colors.

Further, as shown in FIG. 3, the unit side plate 50 of the process cartridge 10 includes the concave portion 52 that fits the convex portion 102 included in the main body side plate 100 of the main body of the image forming apparatus 1 by the attachment operation for attaching the process cartridge 10 to the main body of the image forming apparatus 1. The concave portion 52 of the process cartridge 10 is a hole having a substantially cylindrical shape that is extended along the direction in which the process cartridge 10 is attached to the main body of the image forming apparatus 1. On the other hand, the convex portion 102 of the main body of the image forming apparatus 1 is disposed on the main body side plate 100 at a position corresponding to the position of the concave portion 52. The convex portion 102 of the main body of the image forming apparatus 1 is a protrusion having a substantially cylindrical shape that is formed to protrude toward the process cartridge 10 from the end surface 110 (the surface on which the main body side connecter 101 is formed) facing the end surface 53 of the process cartridge 10. As shown in FIG. 5A, when the process cartridge 10 is correctly mounted on the main body of the image forming apparatus 1 (the mounting unit), the concave portion 52 fits the convex portion 102.

Figure 5B:
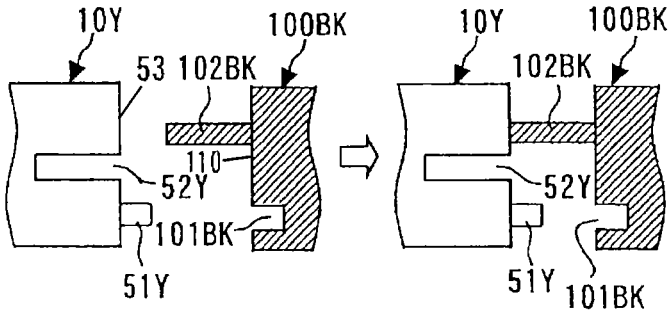
FIG. 5B is a schematic diagram showing a state where the detachable unit is attached to a wrong mounting unit of the main body of the image forming apparatus.

Among the four combinations of the process cartridges 10Y, 10M, 10C, and 10BK and the corresponding mounting units, the positions of the concave portion 52 and the convex portion 102 of one combination are different from those of another combination. Specifically, as shown in FIGS. 4A-4D, the positions in the height direction of the concave portion 52 and the convex portion 102 for one color are different from those for another color. In particular, as shown in FIG. 4A, in the process cartridge 10BK for the black color, the concave portion 52BK is formed at a position where the height from a reference position (a bottom portion) is H1. Further, as shown in FIG. 4B, the convex portion 102BK of the main body side plate 100BK (the mounting unit) for the black color is formed at a position corresponding to the position of the concave portion 52BK of the process cartridge 10BK for the black color. On the other hand, as shown in FIG. 4C, in the process cartridge 10Y for the yellow color, the concave portion 52Y is formed at a position where the height from the reference position (the bottom portion) is H2 (here, H2<H1). Further, as shown in FIG. 4D, the convex portion 102Y of the main body side plate 100Y (the mounting unit) for the yellow color is formed at a position corresponding to the position of the concave portion 52Y of the process cartridge 10Y for the yellow color. As shown in FIG. 5B, with such a configuration, when the process cartridge 10Y for the yellow color is erroneously attempted to be mounted on the mounting unit for the black color (the main body side plate 100BK), the convex portion 102BK for the black color does not fit the concave portion 52Y for the yellow color. The convex portion 102BK for the black color contacts the unit side plate 50 of the process cartridge 10Y for the yellow color, thereby preventing the erroneous insertion. Similarly, when the process cartridge 10BK for the black color is erroneously attempted to be mounted on the mounting unit for the yellow color (the main body side plate 100Y), the convex portion 102Y for the yellow color does not fit the concave portion 52BK for the black color. The convex portion 102Y for the yellow color contacts the unit side plate 50 of the process cartridge 10BK for the black color, thereby preventing the erroneous insertion. In FIGS. 4A-4D, only the process cartridges 10Y and 10BK and the mounting units for the black color and the yellow color are shown, among the four process cartridges 10Y, 10M, 10C, and 10BK and the four mounting units. However, the positions of the concave portion 52 and the convex portion 102 for the magenta color are different from those of the other colors. Similarly, the positions of the concave portion 52 and the convex portion 102 for the cyan color are different from those of the other colors. In the embodiment, the positions of the concave portion 52 and the convex portion 102 of one combination of the process cartridge 10 and the mounting unit are different from those of another combination. Alternatively, the shapes of the concave portion 52 and the convex portion 102 of one combination of the process cartridge 10 and the mounting unit may be different from those of another combination. In this case, an effect that is similar to the above-described effect may also be obtained.

As shown in FIG. 5A, the convex portion 102 of the main body of the image forming apparatus 1 is formed such that the length M2 in the attaching direction between the end surface 110 and an end of the convex portion 102 of the main body of the image forming apparatus 1 is greater than the length M1 in the attaching direction of the unit side connector 51 (or the main side connector 101) (i.e., M2 >M1. With such a configuration, as shown in FIG. 5B, when the process cartridge 10Y for the yellow color is inserted into the mounting unit 100BK for the black color, for example, the unit side connector 51Y, which is incompatible with the main side connector 101BK, does not collide with the main body side connector 101 BK. In this case, the convex portion 102BK contacts the process cartridge 10Y, and the further insertion of the process cartridge 10Y to the mounting unit 100BK is prevented. In this manner, while the damage on the connectors 51 and 101 is prevented, the erroneous insertion of the process cartridge 10 can be surely prevented.

In the embodiment, when the process cartridge 10 (the detachable unit) is projected in the attaching direction, the concave portion 52 of the process cartridge 10 is disposed at a position where the concave portion 52 overlaps a highly rigid member, among the members included in the process cartridge 10. Here, the highly rigid member is totally or partially formed of a highly rigid material such as a metal material, and the member is relatively rigid as a whole. Namely, when any one of the process cartridges 10Y, 10M, 10C, and 10BK is inserted into the mounting portion for a different color, the convex portion 102 contacts the unit side plate 50 at a position where the convex portion 102 faces, through the unit side plate 50, the highly rigid member which is disposed inside. In other words, the concave portion 52 of the process cartridge 10 for one of the colors of yellow, magenta, cyan, and black is disposed at the position corresponding to the position of the highly rigid member of the process cartridge 10 for another color. In particular, for example, the bearing 15*b*1 that rotatably holds the conveyance coil 15*b* as the rotational member of the process cartridge 10, or the holding member 15*c* (the holder) for holding the cleaning blade 15*a* may be used as the highly rigid member. Further, the highly rigid member is disposed in the vicinity of the unit side plate 50 inside the process cartridge 10.

Figure 6A:
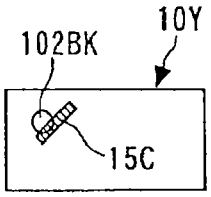
FIG. 6A is a schematic diagram where the detachable unit for the yellow color and the main body of the image forming apparatus are projected in a direction in which the detachable unit is attached.
Figure 6B:
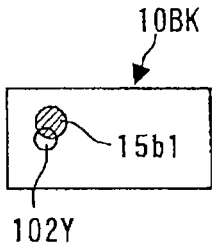
FIG. 6B is a schematic diagram where the detachable unit for the black color and the main body of the image forming apparatus are projected in the direction in which the detachable unit is attached.

Specifically, when the process cartridge 10Y for the yellow color is projected in the attaching direction, the concave portion 52Y of the process cartridge 10Y is disposed at the position that overlaps the bearing 15*b*1. Further, when the process cartridge 10BK for the black color is projected in the attaching direction, the concave portion 52BK of the process cartridge 10BK is disposed at the position that overlaps the holding member (the holder) 15*c*. Therefore, as shown in FIG. 6A, when the process cartridge 10Y for the yellow color is erroneously inserted into the mounting unit for the black color (the main body side plate 100BK), the convex portion 102BK of the mounting unit for the black color contacts the unit side plate 50 at the position facing, through the unit side plate 50, the holding member (holder) 15*c* which is disposed inside the process cartridge 10Y. Further, as shown in FIG. 6B, when the process cartridge 10BK for the black color is erroneously inserted into the mounting unit for the yellow color (the main body side plate 100Y), the convex portion 102Y of the mounting unit for the yellow color contacts the unit side plate 50 at the position facing, through the unit side plate 50, the bearing 15*b*1 which is disposed inside the process cartridge 10BK. With such a configuration, since the unit side plate 50 is reinforced by the highly rigid member, even if the process cartridge 10 is inserted into the wrong mounting unit with great force and the convex portion 102 contacts the unit side plate 50 with large impact force, the unit side plate 50 is not greatly deformed (usually, the unit side plate 50 is formed of a resin material having a relatively low rigidity). Therefore, a failure can be prevented where the unit side plate 50 is damaged. Further, in a case where the process cartridge 10 is removed from the main body of the image forming apparatus 1 and is in a state such as a single body, since the vicinity of the concave portion 52 is reinforced by the highly rigid member, even if unexpected external force is applied to the unit side plate 50, failure can be prevented where the unit side plate 50 is damaged (especially, the damage in the vicinity of the concave portion 52).

Figure 7:
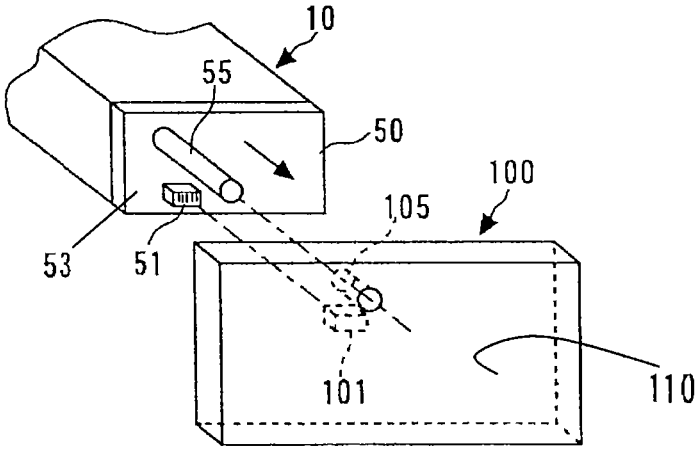
FIG. 7 is a schematic perspective view showing a state in a modified example, where the detachable unit is attached to the main body of the image forming apparatus.

In the embodiment, the concave portion 52 is disposed at the side of the process cartridge 10 (the detachable unit), and the convex portion 102 is disposed at the side of the main body of the image forming apparatus 1 (the main body side plate 100). Alternatively, as shown in FIG. 7, a convex portion 55 may be disposed at the side of the process cartridge 10 (the detachable unit) on the end surface 53 of the process cartridge 10, and a concave portion 105 may be disposed at the side of the main body of the image forming apparatus 1 (the main body side plate 100). In this case, by forming the concave portion 105 and the convex portion 55 similar to the case of the embodiment, an effect that is similar to the above-described effect can be obtained.

As explained above, according to the embodiment, one of the process cartridge 10 (the detachable unit) and the main body of the image forming apparatus 1 includes the concave portion 52 extended along the attaching direction, and the other one of the process cartridge 10 and the main body of the image forming apparatus 1 includes the convex portion 102 disposed at the position corresponding to the position of the concave portion 52. With this configuration, when the process cartridge 10 is attached to the wrong mounting unit of the main body of the image forming apparatus 1, the unit side connector 51 does not collide with the main body side connector 101. Therefore, the unit side connector 51 and the main body side connector 101 are not damaged, and the erroneous insertion of the process cartridge 10 can be prevented.

In the embodiment, each of the process cartridges 10Y, 10M, 10C, and 10BK are formed by integrating the components (the photosensitive drum 11, the charging unit 12, the developing unit 13, the cleaning unit 15, and the lubricant supply device 16) of the image forming unit. In this manner, the size of the image forming unit is reduced, and maintenance workability is improved. Alternatively, the photosensitive drum 11, the charging unit 12, the developing unit 13, the cleaning unit 15, and the lubricant supply device 16 may not be included in the image forming unit, and the charging unit 12, the developing unit 13, the cleaning unit 15, and the lubricant supply device 16 may be formed to be individual detachable units that are attached to the main body of the image forming apparatus 1 as replaceable detachable units. In this case, by forming a concave portion and a convex portion similar to those of the embodiment in each of the detachable units and in each of the corresponding mounting units, an effect that is similar to the effect of the embodiment can be obtained.

In the above explanation, the embodiment is applied to one type of image forming apparatus 1 on which the incompatible process cartridges 10Y, 10M, 10C, and 10BK for the different colors are mounted. However, the embodiment is not limited to this. For example, the embodiment may be applied to process cartridges to be mounted on corresponding different types of image forming apparatuses, or process cartridges to be mounted on corresponding plural image forming apparatuses of which the destinations or the sale destinations are different, so as to ensure the incompatibility among the process cartridges. Further, in the embodiment, the process cartridges 10Y, 10M, 10C, and 10BK have been utilized as the detachable units. However, the embodiment is not limited to this. As the detachable units, other types of detachable units, such as fixing devices or intermediate transfer belt units to be mounted on corresponding different types of image forming apparatuses, may be used. In this case, by forming a concave portion and a convex portion similar to those of the embodiment in each of the detachable units and in each of the corresponding mounting units, an effect that is similar to the effect of the present invention can be obtained.

Hereinabove, the image forming apparatus, the detachable unit, and the plural detachable units have been explained by the embodiment. However, the present invention is not limited to the above-described embodiment, and various modifications and improvements may be made within the scope of the present invention. For example, the number, the positions, and the shapes of the components are not limited to the embodiment, and suitable number, positions, and shapes of the components may be adopted for implementing the present invention.

The present application is based on Japanese Priority Applications No. 2011-281118 filed on Dec. 22, 2011, and No. 2012-194110 filed on Sep. 4, 2012, the entire contents of which are hereby incorporated herein by reference.

What is claimed is:

1. An image forming apparatus, comprising:

a mounting unit positioned in a main body of the image forming apparatus including a main body side connector, and one of a concave portion and a convex portion, wherein the image forming apparatus is configured to be detachably attached to a detachable unit including the other of the concave portion and the convex portion, wherein the main body side connector is configured to fit with a unit side connector of the detachable unit by an attaching operation for attaching the detachable unit to the main body of the image forming apparatus, wherein the concave portion extends along an attaching direction in which the detachable unit is attached to the main body of the image forming apparatus, wherein the convex portion is attached to an end surface of one of the detachable unit and the mounting unit at a position corresponding to the concave portion, and wherein a length in the attaching direction of at least a portion of the main body side connector that receives the unit side connector is less than a length in the attaching direction between an end of the convex portion and the end surface of the one of the detachable unit and the mounting unit.

2. The image forming apparatus according to claim 1, further comprising a plurality of mounting units positioned in the main body of the image forming apparatus, wherein each of the plurality of the mounting units is configured to mount a corresponding detachable unit, wherein each of the plurality of the mounting units includes, located in a respective first position, a concave portion corresponding to a convex portion of a respective corresponding detachable unit, or a convex portion corresponding to a concave portion of the respective corresponding detachable unit, and wherein the respective first position is different for each of the plurality of mounting units.

3. The image forming apparatus according to claim 2, wherein each of the plurality of mounting units includes a main body side connector having a shape that is configured to fit with a unit side connector of the respective corresponding detachable unit, and wherein a shape of a respective main body side connector is different for each of the plurality of mounting units.

4. The image forming apparatus according to claim 1, wherein the one of the concave portion and the convex portion is configured to engage the other of the concave portion and the convex portion, such that the detachable unit is projected in the attaching direction and the other of the concave portion and the convex portion is located at a position overlapping a highly rigid member included in the detachable unit.

5. The image forming apparatus according to claim 4, wherein the highly rigid member is a bearing configured to rotatably support a rotational member.

6. The image forming apparatus according to claim 5, wherein the rotational member is a conveyance member configured to convey waste toner collected from an image carrying body.

7. The image forming apparatus according to claim 4, wherein the highly rigid member is a holding member configured to hold a cleaning blade for removing residual toner remaining on an image carrying body.

8. A detachable unit, comprising:

a unit side connector; and one of a concave portion and a convex portion, wherein the detachable unit is configured to be detachably attached to a main body of an image forming apparatus that includes a main body side connector and the other of the concave portion and the convex portion, wherein the unit side connector is configured to fit with the main body side connector by an attaching operation for attaching the detachable unit to the main body of the image forming apparatus, wherein the concave portion extends along an attaching direction in which the detachable unit is attached to the main body of the image forming apparatus, wherein the convex portion is attached to an end surface of one of the detachable unit and the main body at a position corresponding to the concave portion, and wherein a length of the unit side connector in the attaching direction is less than a length between an end of the convex portion and the end surface of the one of detachable unit and the main body.

9. The detachable unit according to claim 8, wherein the detachable unit is projected in the attaching direction and the one of the concave portion and the convex portion is located on the detachable unit in a position overlapping a highly rigid member included in the detachable unit.

10. The detachable unit according to claim 9, wherein the highly rigid member is a bearing configured to rotatably support a rotational member.

11. The detachable unit according to claim 10, wherein the rotational member is a conveyance member configured to convey waste toner collected from an image carrying body.

12. The detachable unit according to claim 9, wherein the highly rigid member is a holding member configured to hold a cleaning blade for removing residual toner remaining on an image carrying body.

13. A system comprising:

at least one of a writing unit that emits laser light based on input image information and an image carrying body;

a main body; and a plurality of combinations, each combination including a mounting unit that is positioned in the main body and includes a main body side connector and a first portion, and a detachable unit configured to be detachably attached to the mounting unit and includes a unit side connector and a second portion, wherein, for each combination, the unit side connector is configured to fit with the main body side connector by an attaching operation for attaching the detachable unit to the mounting unit, a position of the first portion corresponds to a position of the second portion, the first portion is one of a concave portion and a convex portion and the second portion is the other of the concave portion and the convex portion, the concave portion extends in an attaching direction for attaching the detachable unit to the mounting unit, the convex portion is attached to an end surface of one of the detachable unit and the mounting unit, and a length in the attaching direction between an end of the convex portion and the end surface of the one of the detachable unit and the mounting unit is greater than a length in the attaching direction of the unit side connector or at least a portion of the main body side connector that receives the unit side connector.

14. The system according to claim 13, wherein corresponding shapes of a respective unit side connector and a respective main body side connector are different for each combination.

15. The system according to claim 13, wherein corresponding positions of a respective first portion and a respective second portion are different for each combination.

16. The image forming apparatus according to claim 1, wherein the main body side connector is connected to a power supply.

17. The image forming apparatus according to claim 15, wherein the unit side connector is fit to the main body side connector and the main body side connector forms an electrical connection with the unit side connector.

* * * * *